US005378037A

United States Patent [19]

Beasley et al.

[11] Patent Number: 5,378,037

[45] Date of Patent: Jan. 3, 1995

[54] RELOADING BENCH

[76] Inventors: Rodney P. Beasley; Bernice F. Beasley, both of 1014 Doan St., Texarkana, Ark. 75502

[21] Appl. No.: 41,152

[22] Filed: Apr. 1, 1993

[51] Int. Cl.[6] ..... A47B 39/00

[52] U.S. Cl. ..... 297/174; 297/135; 297/182

[58] Field of Search ..... 297/174, 135, 182, 188, 297/217; 108/144, 50; 42/94; 312/235.2

[56] References Cited

U.S. PATENT DOCUMENTS

| | | | |
|---|---|---|---|
| 1,265,977 | 5/1918 | Vordermark | 297/135 X |
| 4,296,963 | 10/1981 | Blanchard et al. | 297/135 X |
| 4,482,185 | 11/1984 | Zoellner | 297/135 |
| 4,506,466 | 3/1985 | Hall | 42/94 |
| 4,506,903 | 3/1985 | Bowermaster | 297/188 X |
| 4,921,302 | 5/1990 | Godwin | 297/174 X |
| 5,173,563 | 12/1992 | Gray | 42/94 |
| 5,213,392 | 5/1993 | Bostrom et al. | 297/217 |

FOREIGN PATENT DOCUMENTS

| | | | |
|---|---|---|---|
| 245864 | 7/1963 | Australia | 297/174 |
| 2028792 | 12/1971 | Germany | 42/94 |

*Primary Examiner*—Laurie K. Cranmer

[57] ABSTRACT

A new and improved reloading bench apparatus includes a horizontal base unit, a first vertical support projecting vertically from the horizontal base unit, a second vertical support projecting vertically from the horizontal base unit, a third vertical support projecting vertically from the horizontal base unit, and a work platform supported by the first, second, and third vertical supports. A seat assembly is connected to at least one of the first and second vertical supports. The seat assembly includes lower horizontal frame members, adjustable vertical leg members projecting from the lower horizontal frame members, upper horizontal frame members supported by the vertical leg members, and a seat platform supported by the upper horizontal frame members. Connectors, such as nuts and bolts, are used for connecting at least one of the vertical leg members to at least one of the second or third vertical supports. A brace member may be connected between the first vertical support and the work platform. The first vertical support projects vertically from a predetermined position on the horizontal base unit that is distal to edges of the horizontal base unit. The second vertical support and the third vertical support are positioned adjacent to an edge of the horizontal base unit. A receptacle, to receive wastes to prevent environmental pollution, is supported by the upper horizontal frame members. The receptacle includes flanges for supporting the receptacle on the upper horizontal frame members.

10 Claims, 4 Drawing Sheets

FIG 3
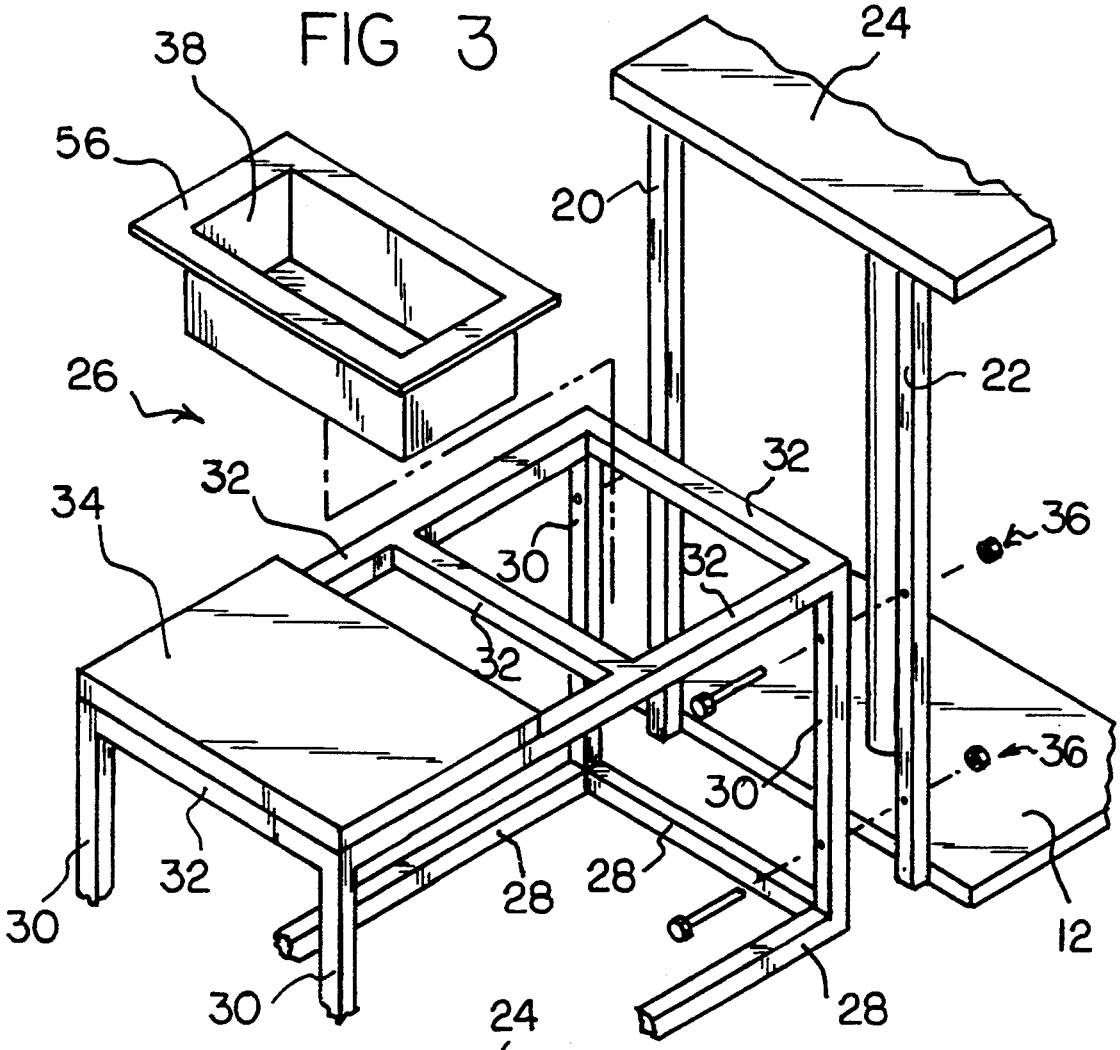
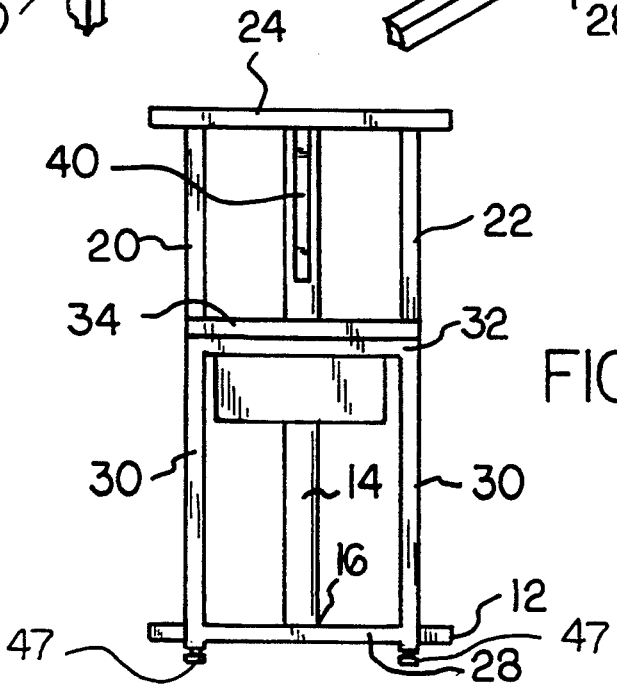
FIG 4

FIG 7
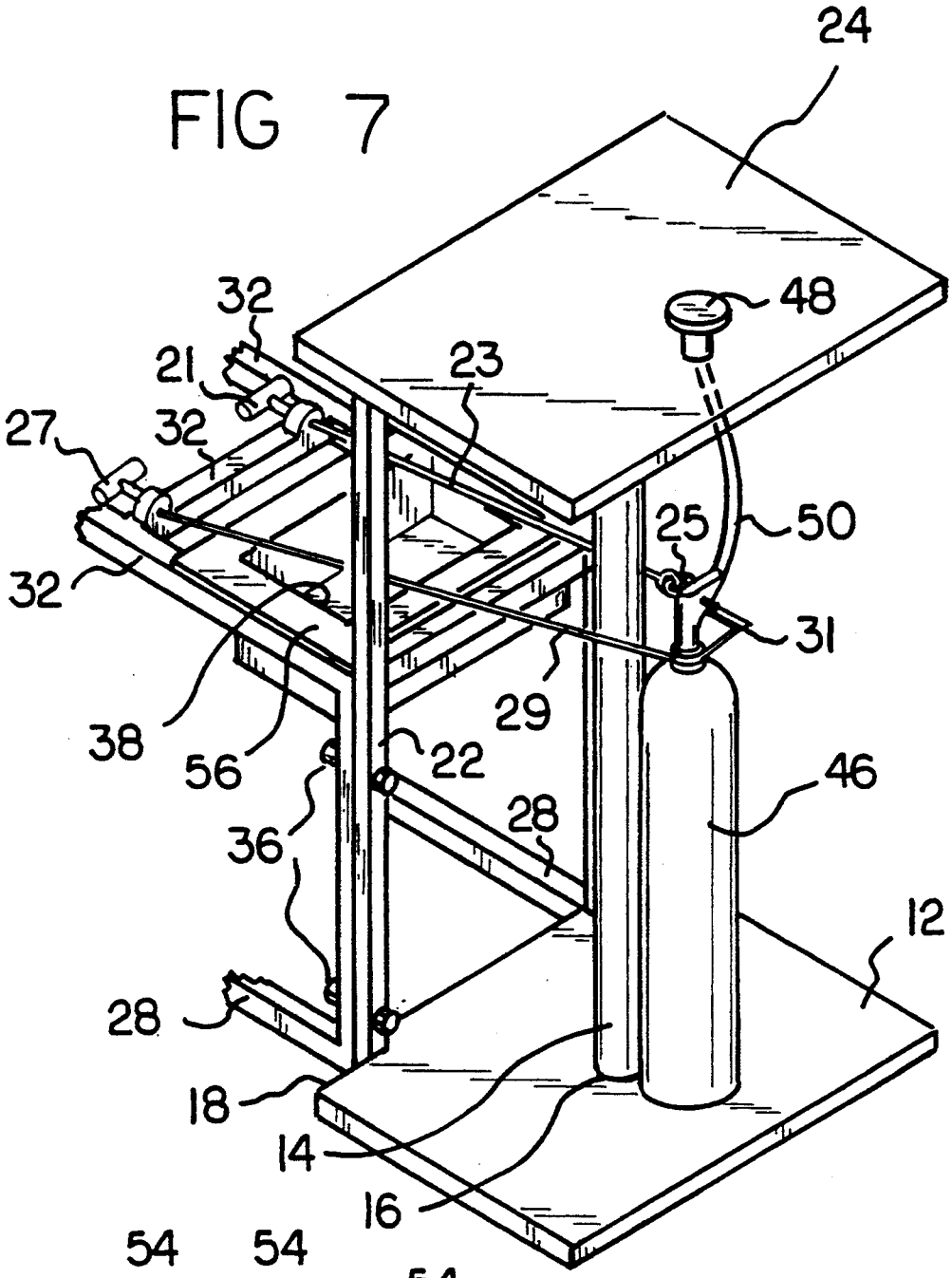
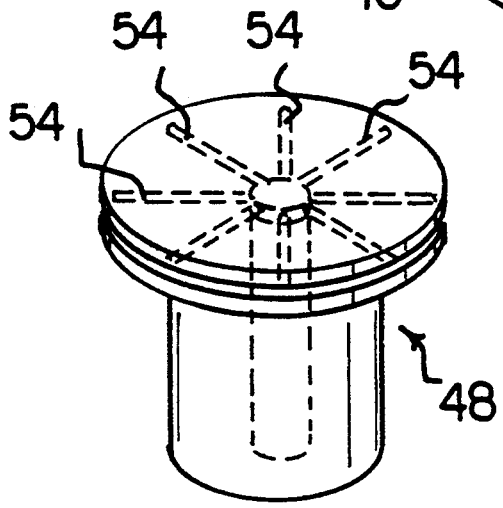
FIG 8

RELOADING BENCH

BACKGROUND OF THE INVENTION

1. Field of the Invention

The present invention relates generally to portable work benches, and more particularly, to a portable work bench especially adapted for reloading ammunition.

2. Description of the Prior Art

Portable work benches are well known in the art. For example, U.S. Pat. No. 3,589,311 discloses a knock-down type portable work bench. Also, U.S. Pat. No. 4,506,466 discloses a portable shooters's bench. Other portable work holders are also known. For example, U.S. Pat. No. 3,669,392 discloses a collapsible stand-up tray holder.

A number of patents disclose portable presses designed for reloading ammunition. For example, U.S. Pat. No. 4,047,685 discloses a portable stand for reloading presses. In the device disclosed in this patent, a reloading press is mounted on a collapsible stand that has a base supporting an inclined pedestal the upper end of which is arranged for mounting the press on a vertical axis disposed intermediated transverse feet located at the front and rear ends of the base, providing a stable platform for operation of the press. A brace interconnects the pedestal and the base intermediate their ends securing the pedestal at its inclined orientation relative to the base. The stand is collapsible for storage to minimum dimensions with all of the components securable against displacement.

Also, U.S. Pat. No. 4,222,546 discloses a portable work stand primarily designed to support a plurality of different types of reloading presses and related equipment to allow a variety of operations to be performed on metallic cartridges and shotshell cases without the necessity of changing presses. The work stand includes a base which is universally mountable to the hub portion of tires.

A common disadvantage of all of the work benches or work stands disclosed above is that a person using a respective bench or stand must either do without a seat or must bring along a separate seat. Working without a seat can be very tiring. Having to bring along a separate seat can be very inconvenient. In this respect, it would be desirable if a reloading bench apparatus were provided that avoided the necessity of working without a seat. Moreover, it would also be desirable if a reloading bench apparatus were provided that precluded the necessity of the inconvenience of bringing along a separate seat.

Another problem associated with the prior art work benches and work stands is the problem of handling waste materials that are generated in using the equipment. More specifically, either the waste materials are released into the environment causing undesirable pollution, or separate waste receptacle must be accessed to dispose of accumulated wastes. In this respect, it would be desirable if a reloading bench apparatus were provided which included a receptacle for wastes to prevent pollution of the environment.

It is noted that the devices disclosed above that are specifically designed for reloading ammunition have single vertical support elements for supporting the respective work surfaces. A single vertical support element, by its very nature, is relatively unstable. Such instability is especially undesirable in an ammunition reloading apparatus which requires precision and stability. In this respect, it would be desirable if a reloading bench apparatus were provided that had improved stability of the work surface.

The devices disclosed above that are specifically designed for reloading ammunition have essentially open work surfaces without any storage areas for storing materials. In reloading ammunition, numerous hazardous materials are present. In this respect, it would be desirable if a reloading bench apparatus were provided that had special structures for storing hazardous materials.

Some of the hazardous materials involved ammunition reloading are highly flammable. Yet none of the prior art reloading apparatus disclosed above have provisions for fighting a fire. Hauling a fire extinguisher along with a work bench can be an inconvenience. In this respect, it would be desirable if a reloading bench apparatus were provided that included a built in fire extinguisher and that included built in means for rapid actuation and distribution of fire extinguishing material.

Thus, while the foregoing body of prior art indicates it to be well known to use portable work stands for reloading ammunition, the prior art described above does not teach or suggest a reloading bench apparatus which has the following combination of desirable features: (1) avoids the necessity of working without a seat; (2) precludes the necessity of the inconvenience of bringing along a separate seat; (3) includes a receptacle for wastes to prevent pollution of the environment; (4) has improved stability of the work surface; (5) has special structures for storing hazardous materials; and (6) includes a built in fire extinguisher and includes built in means for rapid actuation and distribution of fire extinguishing material. The foregoing desired characteristics are provided by the unique reloading bench apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved reloading bench apparatus which includes a horizontal base unit, a first vertical support projecting vertically from the horizontal base unit, a second vertical support projecting vertically from the horizontal base unit, a third vertical support projecting vertically from the horizontal base unit, and a work platform supported by the first, second, and third vertical supports.

A seat assembly is connected to at least one of the first and second vertical supports. The seat assembly includes lower horizontal frame members, adjustable vertical leg members projecting from the lower horizontal frame members, upper horizontal frame members supported by the vertical leg members, and a seat platform supported by the upper horizontal frame members. Connectors, such as nuts and bolts, are used for connecting at least one of the vertical leg members to at least one of the second or third vertical supports.

A brace member may be connected between the first vertical support and the work platform. The first vertical support projects vertically from a predetermined position on the horizontal base unit that is distal to edges of the horizontal base unit. The second vertical support and the third vertical support are positioned adjacent to an edge of the horizontal base unit.

A receptacle, to receive wastes to prevent environmental pollution, is supported by the upper horizontal frame members. The receptacle includes flanges for supporting the receptacle on the upper horizontal frame members.

A drawer assembly is supported on an under surface of the work platform. The drawer assembly is made of explosive resistant materials.

A fire extinguisher assembly includes an extinguishant storage and valve unit attached to one of the first, second, or third vertical supports. A dispenser head is connected to the work platform, and a conduit is connected between the extinguishant storage and valve unit and the dispenser head. An actuator assembly is connected between at least one of the upper horizontal frame members and the extinguishant storage and valve unit. The dispenser head includes a radial array of nozzles.

The first, second, and third vertical supports provide three support points for the work platform. In this way, the stabilizing benefits of a triangular support are employed for supporting the work platform. Moreover, the connections between second vertical support and third vertical support of the work platform and adjacent vertical leg members of the seat assembly add further to the stability of the reloading bench apparatus of the invention.

The work platform can include the following reloading equipment: rifle press; scales; case trimmer; de-burn tool; automatic priming tool; RCBS powder measurer; and powder trickier. These items can be used for reproduction of rifle, pistol, and shot gun ammunition.

The reloading bench apparatus of the invention provides a complete reloading system in the convenience of one's home, camp, or the shooting range. To store the reloading bench apparatus of the invention, it can be placed on a closet or even in the trunk of an automobile.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved reloading bench apparatus which has all of the advantages of the prior art and none of the disadvantages.

It is another object of the present invention to provide a new and improved reloading bench apparatus which may be easily and efficiently manufactured and marketed.

It is a further object of the present invention to provide a new and improved reloading bench apparatus which is of durable and reliable construction.

An even further object of the present invention is to provide a new and improved reloading bench apparatus which is susceptible of a low cost of manufacture with regard to both materials and labor, and which accordingly is then susceptible of low prices of sale to the consuming public, thereby making such reloading bench apparatus available to the buying public.

Still yet a further object of the present invention is to provide a new and improved reloading bench apparatus that avoids the necessity of working without a seat.

Still another object of the present invention is to provide a new and improved reloading bench apparatus that precludes the necessity of the inconvenience of bringing along a separate seat.

Yet another object of the present invention is to provide a new and improved reloading bench apparatus which includes a receptacle for receiving wastes to prevent pollution of the environment.

Even another object of the present invention is to provide a new and improved reloading bench apparatus that provides improved stability for the work surface.

Still a further object of the present invention is to provide a new and improved reloading bench apparatus that has special structures for storing hazardous materials.

Yet another object of the present invention is to provide a new and improved reloading bench apparatus that includes a built in fire extinguisher and that includes built in means for rapid actuation and distribution of fire extinguishing material.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is an enlarged, partially exploded view of the embodiment of the invention shown in FIG. 1.

FIG. 4 is a front view of the embodiment of the invention shown in FIG. 1.

FIG. 7 is a partial perspective view of a third embodiment of the invention of the reloading bench apparatus which includes a built in fire extinguisher and extinguisher actuation apparatus.

FIG. 8 is an enlarged perspective view of a radial dispenser for fire extinguishing material from the built in fire extinguisher shown in FIG. 7.

DESCRIPTION OF THE PREFERRED EMBODIMENT

Figure 1:
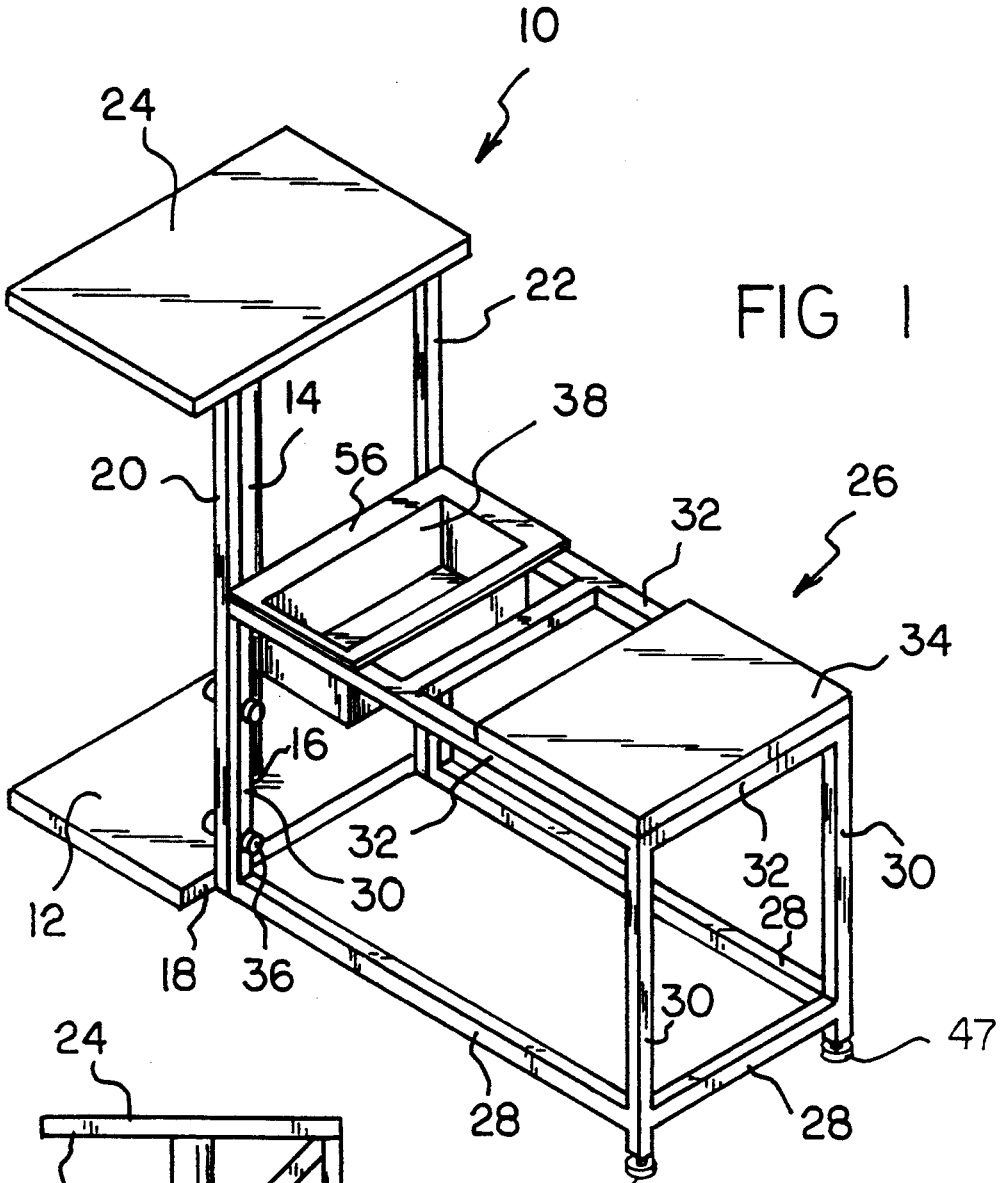
FIG. 1 is a perspective view showing a first preferred embodiment of the reloading bench apparatus of the invention.

With reference to the drawings, a new and improved reloading bench apparatus embodying the principles and concepts of the present invention will be described.

Turning initially to FIGS. 1–4, there is shown a first exemplary embodiment of the reloading bench apparatus of the invention generally designated by reference numeral 10. In its preferred form, reloading bench apparatus 10 includes a horizontal base unit 12, a first vertical support 14 projecting vertically from the horizontal base unit 12, a second vertical support 20 projecting vertically from the horizontal base unit 12, a third vertical support 22 projecting vertically from the horizontal base unit 12, and a work platform 24 supported by the first, second, and third vertical supports.

A seat assembly 26 includes lower horizontal frame members 28, adjustable vertical leg members 30 projecting from the lower horizontal frame members 28, upper horizontal frame members 32 supported by the vertical leg members 30, a seat platform 34 supported by the upper horizontal frame members 32, and first connectors 36 for connecting two of the vertical leg members 30 to adjacent second and third vertical supports 20 and 22, respectively. The second vertical support 20 and the third vertical support 22 are positioned adjacent to an edge 18 of the horizontal base unit 12.

Figure 2:
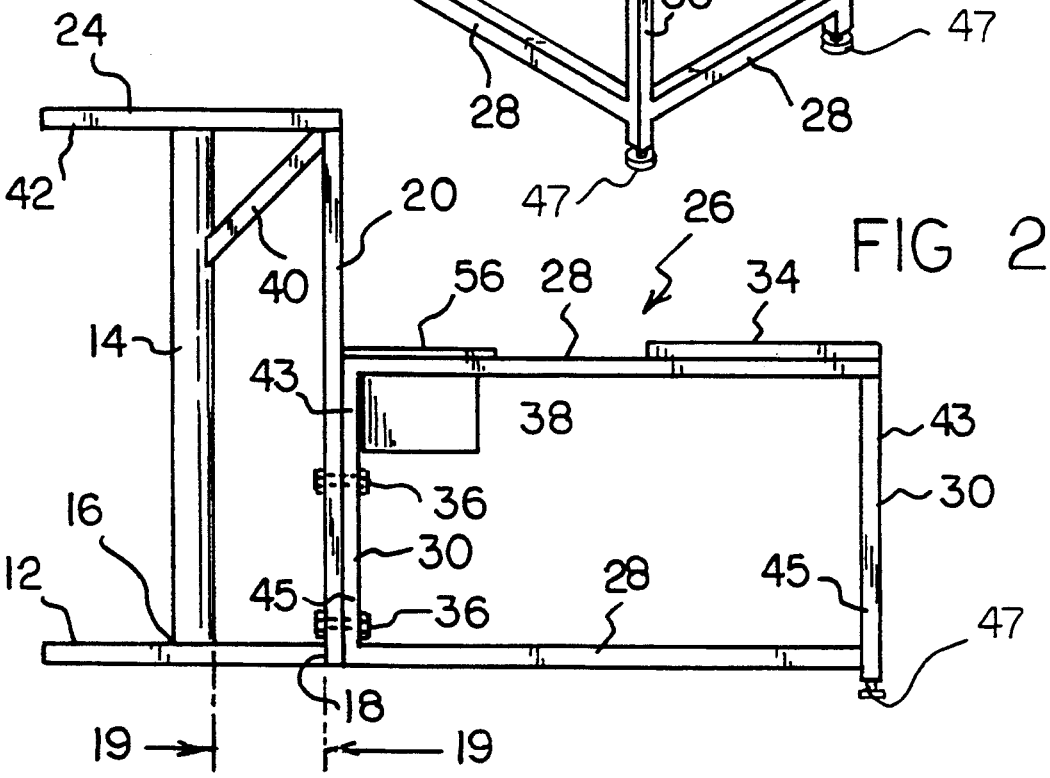
FIG. 2 is a side view of the reloading bench apparatus shown in FIG. 1.

The adjustable vertical leg members 30 in FIG. 2 are shown to include upper portions 43 and lower portions 45 with the bottom portions of the outermost pair of leg members 30 (i.e. right-hand pair as viewed in FIG. 2) having suitably affixed to their bottommost extremities, respectively, a rotatably adjustable foot member 47 threadedly received in an axial hole in each extremity (not shown), substantially as depicted. As will occur to those skilled in the art, rotation of each foot member 47 relative to each bottom portion 45 will raise or lower leg 30 so as to effect selective height adjustment of the rightmost portion of seat assembly 26.

A brace member 40 is connected between the first vertical support 14 and the work platform 24 to provide added stability of the work platform 24 to the first vertical support 14. The first vertical support 14 projects vertically from a predetermined position 16 on the horizontal base unit 12 that is distal to edges 18 of the horizontal base unit 12 by a distance 19.

A receptacle 38, for receiving wastes, such as powder wastes, to prevent environmental pollution, is supported by the upper horizontal frame members 32. The receptacle 38 includes flanges 56 for supporting the receptacle 38 on the upper horizontal frame members 32.

Suitable means are also used to connect lower horizontal frame members 28 to vertical leg members 30, to connect vertical leg members 30 to upper horizontal frame members 32, to connect the work platform 24 to the first vertical support 14 and the first and second vertical supports 20 and 22, to connect the horizontal base unit 12 to the first vertical support 14 and the first and second vertical supports 20 and 22, to connect the seat platform 34 to the upper horizontal frame members 32, to connect lower horizontal frame members 28 to each other, and to connect upper horizontal frame members 32 to each other. These connections preferably are made by welding the parts to together, or in the case of the seat platform using conventional nut and bolt fastener assemblies. Alternatively, the various structural members may be connected to each other via conventional nut and bolt fasteners or threaded screws passing through one member and engaging a complimentary female threaded hole in another member as will occur to those skilled in the art of fabricating work benches.

Figure 5:
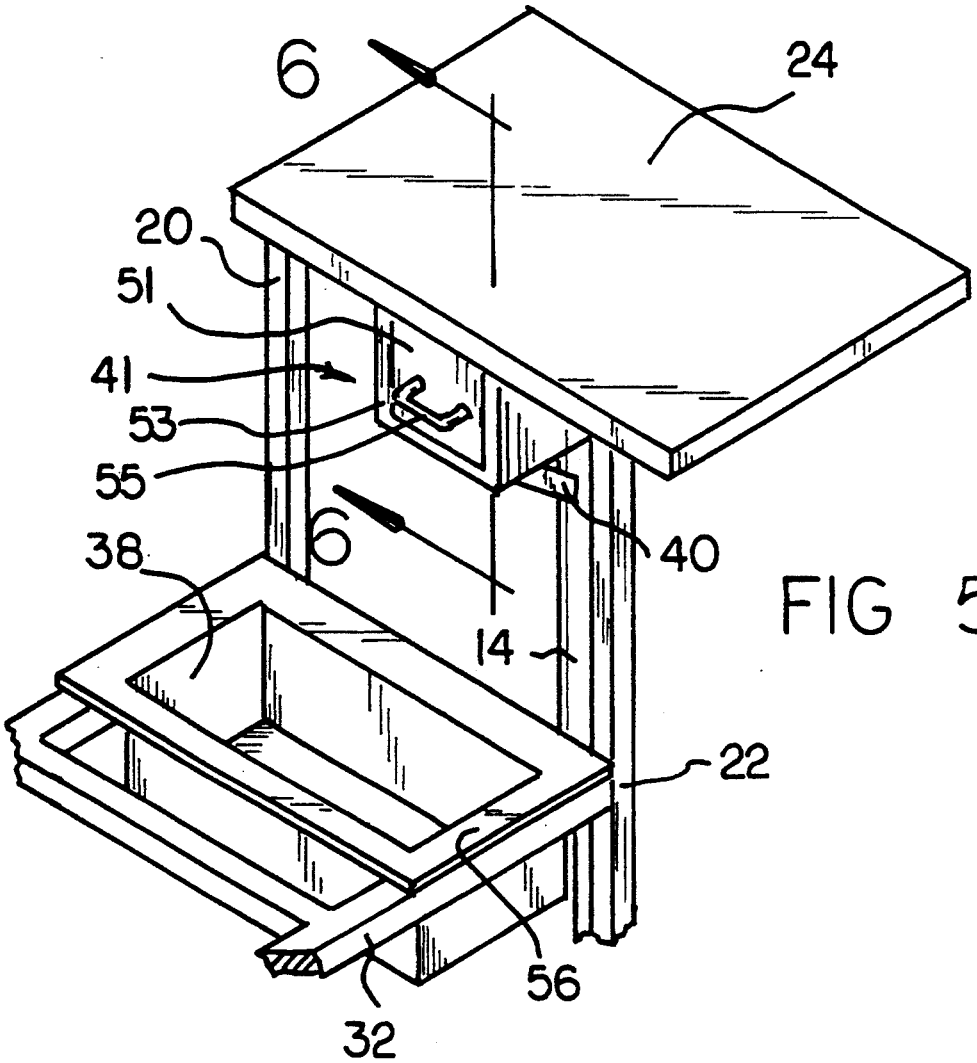
FIG. 5 is a partial perspective view of the second preferred embodiment of the invention which includes an explosive resistant drawer.
Figure 6:
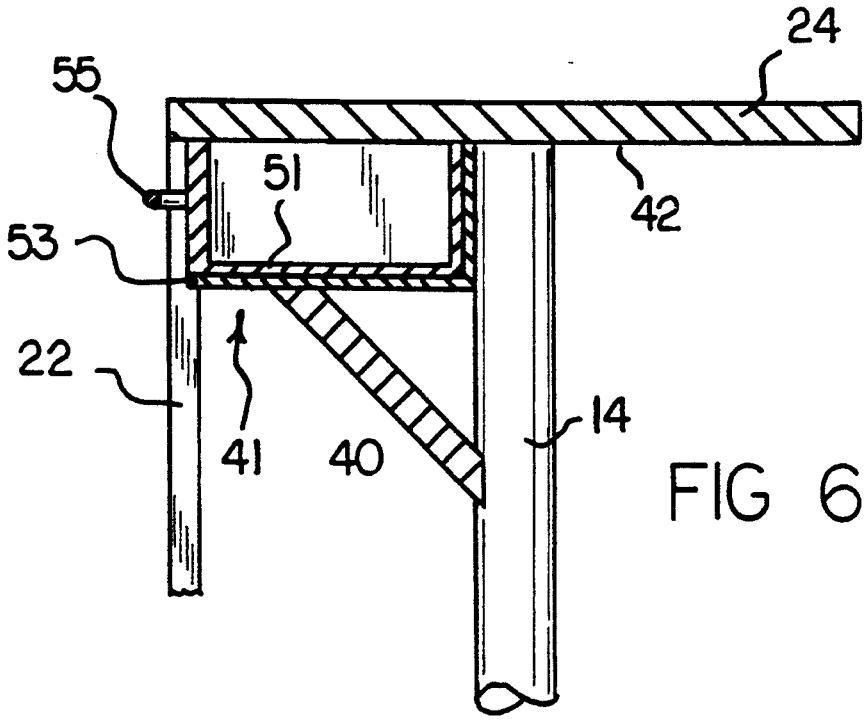
FIG. 6 is a cross-sectional view of the embodiment of the invention shown in FIG. 5 taken along the line 6—6 thereof.

Turning to FIGS. 5–6, a second embodiment of the invention is shown. Reference numerals are shown that correspond to like reference numerals that designate like elements shown in the other figures. In addition, a drawer assembly 41 is supported on an under surface 42 of the work platform 24. The drawer assembly 41 includes a drawer 51 and a housing 53 for the drawer 51. A handle 55 is used for pulling the drawer 51 out of the housing 53. Both the drawer 51 and the housing 53 may be made of explosive resistant materials, such as, for example, heavy gauge steel.

Turning to FIGS. 7–8, a third embodiment of the invention is shown. Reference numerals are shown that correspond to like reference numerals that designate like elements shown in the other figures. In addition, a fire extinguisher assembly includes an extinguishant storage and valve unit 46 attached to the first vertical support 14. A dispenser head 48 is connected to the work platform 24. A conduit 50 is connected between the extinguishant storage and valve unit 46 and the dispenser head 48. An actuator assembly is connected between an upper horizontal frame member 32 and the extinguishant storage and valve unit 46. As shown in FIG. 8, the dispenser head 48 includes a radial array of nozzles 54.

More specifically, the actuator assembly for the extinguishant storage and valve unit 46 includes a first handle 21 supported by an upper horizontal frame member 32, a first cable 23 connected to the first handle 21 and to a locking pin 25 of the extinguishant storage and valve unit 46. Once the first handle 21 is pulled, the locking pin 25 is removed from the extinguishant storage and valve unit 46. A second handle 27 is also supported by an upper horizontal frame member 32 and is connected by a second cable 29 to a valve control assembly 31. When the second handle 27 is pulled, extinguishant is released from the extinguishant storage and valve unit 46, flows through the conduit 50, and is distributed through the nozzles 54 of the dispenser head 48 onto the top surface of the work platform 24.

The components of the reloading bench apparatus of the invention can be made from inexpensive and durable metal or plastic materials.

The embodiments of the reloading bench apparatus of the invention are portable and are easily disassembled and assembled for convenient transportation and storage. The structures of the reloading bench apparatuses of the invention can be connected to each other with easily assembled and disassembled conventional friction fits, snap fits, and nuts and bolts.

It is apparent from the above that the present invention accomplishes all of the objects set forth by providing a new and improved reloading bench apparatus that is low in cost, relatively simple in design and operation, and which may advantageously be used to avoid the necessity of working without a seat. Also, with the invention, the necessity of the inconvenience of bringing along a separate seat is precluded. With the invention, a reloading bench apparatus is provided which includes a receptacle for wastes to prevent pollution of the environment. With the invention, a reloading bench apparatus is provided that has improved stability for the work surface. With the invention, a reloading bench apparatus is provided that has special structures for storing hazardous materials. With the invention, a built in fire extinguisher is provided that includes built in means for rapid actuation and distribution of fire extinguishing material.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved reloading bench apparatus, comprising:

a horizontal base unit, a first vertical support projecting vertically from said horizontal base unit, a second vertical support projecting vertically from said horizontal base unit, a third vertical support projecting vertically from said horizontal base unit, a work platform supported by said first, second, and third vertical supports, a seat assembly which includes vertical leg members and upper horizontal frame members supported by said vertical leg members, a seat platform supported by said upper horizontal frame members, and first connectors for connecting at least one of said vertical leg members to at least one of said second or third vertical supports, further including a receptacle, supported by said upper horizontal frame members in a position between said seat platform and said at least one of said second or third vertical supports.

2. The apparatus described in claim 1, further including a brace member connected between said first vertical support and said work platform.

3. The apparatus described in claim 1 wherein said first vertical support projects vertically from a predetermined position on said horizontal base unit that is distal to edges of said horizontal base unit.

4. The apparatus described in claim 1 wherein said second vertical support and said third vertical support are positioned adjacent to an edge of said horizontal base unit.

5. The apparatus described in claim 1 wherein said vertical leg members are adjustable.

6. The apparatus described in claim 1 wherein said receptacle includes flanges for supporting said receptacle on said upper horizontal frame members.

7. The apparatus described in claim 1, further including a drawer assembly supported on an under surface of said work platform.

8. The apparatus described in claim 7 wherein said drawer assembly is made of explosive resistant materials.

9. A new and improved reloading bench apparatus, comprising:

a horizontal base unit, a first vertical support protecting vertically from said horizontal base unit, a second vertical support projecting vertically from said horizontal base unit, a third vertical support projecting vertically from said horizontal base unit, a work platform supported by said first, second, and third vertical supports, a seat assembly which includes vertical leg members and upper horizontal frame members supported by said vertical leg members, a seat platform supported by said upper horizontal frame members, and first connectors for connecting at least one of said vertical leg members to at least one of said second or third vertical supports, further including fire extinguisher assembly means, including an extinguishant storage and valve unit attached to one of said first, second, or third vertical supports, a dispenser head connected to said work platform, a conduit connected between said extinguishant storage and valve unit and said dispenser head, and actuator assembly means connected between at least one of said upper horizontal frame members and said extinguishant storage and valve unit.

10. The apparatus described in claim 9 wherein said dispenser head includes a radial array of nozzles.

* * * * *